US005433385A

United States Patent [19]

Sakagami et al.

[11] Patent Number: 5,433,385

[45] Date of Patent: Jul. 18, 1995

[54] FUEL INJECTING APPARATUS

[75] Inventors: Eiji Sakagami, Anjo; Susumu Sugimoto; Nobuyuki Oota, both of Kariya, all of Japan

[73] Assignee: Aisin Seiki Kabushiki Kaisha, Kariya, Japan

[21] Appl. No.: 182,838

[22] Filed: Jan. 19, 1994

[30] Foreign Application Priority Data

Jan. 21, 1993 [JP] Japan ..... 5-008535
Mar. 17, 1993 [JP] Japan ..... 5-057260

[51] Int. Cl.[6] ..... F02M 43/00; F02D 41/00

[52] U.S. Cl. ..... 239/585.1; 239/417.3

[58] Field of Search ..... 239/585.1–585.5, 239/407–409, 417.3; 123/531, 533, 90.11; 137/898, 596.17

[56] References Cited

U.S. PATENT DOCUMENTS 4,020,803 5/1977 Thuren et al. ..... 123/90.11
4,655,255 4/1987 Rode ..... 137/596.17
4,962,890 10/1990 Shindo et al. ..... 239/533.4
5,104,046 4/1992 Sakagami ..... 239/585.4

*Primary Examiner*—Karen B. Merritt
*Attorney, Agent, or Firm*—Burns, Doane, Swecker & Mathis

[57] ABSTRACT

A fuel injecting apparatus includes a housing, a bobbin around which a coil is wound, a first core member disposed at one side of the bobbin, a second core member disposed in the bobbin so as to define a clearance with the first core member, and a nozzle disposed at one end of the housing which has an injecting opening. A first movable member is disposed in the bobbin and includes a first projection portion which forms a first gap with the second core member, and a second movable member is disposed in the bobbin and includes a second projection portion which forms a second gap with the first core member. The second movable member includes a fuel measuring device therein. A third movable member is slidably fit in the nozzle so as to define a third gap at one end thereof with the second movable member, and a valve member is disposed between the first movable member and the second movable member. A first spring member is disposed between the first core member and the second projection portion of the second movable member, while a second spring member is disposed between the first core member and the first projection portion of the first movable member. The second spring member includes a spring force which is larger than that of the first spring member. A third spring member is also provided which forces the third movable member so as to close the injecting opening.

15 Claims, 5 Drawing Sheets

FUEL INJECTING APPARATUS

BACKGROUND OF THE INVENTION

1. Field of the invention

This invention relates to a fuel injecting apparatus mainly used for an engine of a vehicle.

2. Description of the Related Art

A conventional fuel injecting apparatus is disclosed in the Japanese Patent Laid Open No. 3 (1991)-172574 (the corresponding U.S. Pat. No. 5,104,046). As shown in FIG. 5, the fuel injecting apparatus disclosed in the prior art comprises a housing 100 including an air inlet 101 for introducing air under high pressure. A case 102 is fixed to the right end of the housing 100 shown in the FIG. 5. The case 102 includes a fuel inlet 103 for introducing fuel.

A bobbin 105 around which a coil 104 is wound is disposed in the housing 100. The coil 104 is capable of flowing electric current. A core member 106 which is located at the left side in a center hole of the bobbin 105 is fixed to the housing 100. A nozzle 107 is fixed to the core member 106.

A first movable member 108 is formed of magnetic material. The first movable member 108, which is able to be slid in the right and left direction shown in FIG. 5, is disposed at the right side in the center hole of the bobbin 105. The first movable member 108 is opposite to the core member 106 with a gap and forced in the right direction by a spring member 109. The first movable member 108 includes a fuel chamber 115 which is always connected with the fuel inlet 103 therein. A second movable member 110 which is also formed of magnetic material is located in the core member 106. The second movable member 110 is opposite to the first movable member 108 with a gap and the second movable member 110 is able to be slid in the right and left directions shown in FIG. 5. The second movable member 110 is formed in the C-shaped configuration. A rod member 112 which is provided in the fuel chamber 115 is fitted in an opening portion of the second movable member 110. A ball 111 which is formed of non-magnetic material is fixed on the left side of the second movable member 110. Further, a third movable member 116 is disposed in the core member 106 so as to be able to be slid in the right and left directions shown in the FIG. 5. The third movable member 116 is opposite to the ball 111 and the third movable member 116 includes a valve seat 117 so as to be able to be contacted with and separated from the ball 111 selectively at the right side thereof.

A spring member 113 forces the ball 111 to be rested on the valve seat 117 through the rod member 112 and the second movable member 110. The spring force of the spring member 109 is provided to be larger than that of the spring member 113.

A fuel passage 123 is disposed in the third movable member 116, The fuel passage 123 is connected with a mixture chamber 120 which is disposed in the core member 106, The fuel passage 123 is connected with the fuel chamber 115 when the ball 111 comes apart from the valve seat 117, The mixture chamber 120 is always connected with the air inlet 101 and partitioned from the fuel chamber 115 by a diaphragm 121.

A rod 118 which is inserted into the third movable member 116 is fit in the nozzle 107. The nozzle 107 has a fuel outlet 128 at a tip thereof, The rod 118 includes an outward opening valve 119 at the left end thereof shown in the FIG, 5 to open and close the fuel outlet 128. A fuel injecting passage 124 which is always connected with the mixture chamber 120 is disposed between the rod 118 and the nozzle 107. The third movable member 116 is biassed so as to close the outward opening valve 119 by a spring member 125.

An operation of the conventional fuel injecting apparatus will be described with FIGS. 5 and 6 hereinafter. The mixture chamber 120 is always filled with the air under the high pressure introduced by an air pump (not shown in the FIGURES) through the air inlet 101. Further the fuel chamber 115 is always supplied with the fuel under the high pressure which is higher than that of the air in the mixture chamber 120 through the fuel inlet 103.

When a small amount of electric current is flowed in the coil 104 indicated at D in the FIG. 6, the electromagnetic force which is smaller than the spring force of the spring member 109 is applied to the first movable member 108 and the other electromagnetic force which is larger than the spring force of the spring member 113 is applied to the second movable member 110. Therefore the second movable member 110 is attracted to the first movable member 108 against the spring force of the spring member 113 without the movement of the first movable member 108. Therefore the ball 111 comes apart from the valve seat 117 of the third movable member 116. Consequently, the fuel introduced into the fuel chamber 115 is supplied into the mixture chamber 120 through the fuel passage 123 to be measured. Finally the fuel in the mixture chamber 120 is supplied to the fuel injecting passage 124.

When a large amount of electric current is flowed in the coil 104 indicated at E in the FIG. 6 in the next process, the electromagnetic force which is larger than the spring force of the spring member 109 is applied to each of the spaces between the core member 106 and the first movable member 108 and between the first movable member 108 and the second movable member 110. Therefore the first movable member 108 is attracted to the core member 106 against the spring force of the spring member 109. Therefore the second movable member 110 which is continued not to be contacted with the valve seat 117 is forced in the left direction shown in the FIG. 5. When the ball 111 rested on the valve seat 117, the fuel chamber 115 is closed to the fuel passage 123. Later on the third movable member 116 is moved in the left direction shown in the FIG. 5 by the first movable member 108 against the spring force of the spring member 125 through the second movable member 110 and the ball 111. Therefore, since the outward opening valve 119 is opened, the fuel in the mixture chamber 120 with the high pressure air is injected out from the fuel outlet 128 through the fuel injecting passage 124. As mentioned above, a cycle of the operation of the conventional fuel injecting apparatus is formed with the measuring process (indicated at D in the FIG. 6) and the injecting process (indicated at E in the FIG. 6) of the fuel.

Under the condition of the high rotational speed of the engine, since the fuel injecting apparatus needs to inject an amount of the fuel, it takes a lot of time to measure the quantity of the fuel. However in accordance with the conventional fuel injecting apparatus, the measuring process and the injecting process are independent each other, therefore a longer measuring time brings a shorter injecting time under the condition of the high rotational speed of the engine. On the contrary, a longer injecting time brings a shorter measuring time under the condition of the high rotational speed of the engine, therefore the conventional fuel injecting apparatus can not inject a sufficient amount of fuel.

SUMMARY OF THE PRESENT INVENTION

It is an object of the present invention to provide an improved fuel injecting apparatus which is capable to supply a sufficient long measuring time and injecting time.

It is another object of the present invention to provide an improved fuel injecting apparatus which can be applied to a high rotational speed type engine.

It is further object of the present invention to provide an improved fuel injecting apparatus is convenient for its assembly.

It is further object of the present invention to provide an improved fuel injecting apparatus which comprises durability.

It is a further object of the present invention to provide an improved fuel injecting apparatus which is available for any kind of an engine.

It is a further object of the present invent ion to provide an improved fuel injecting apparatus which can be easily manufactured.

It is a further object of the present invention to provide an improved fuel injecting apparatus which is simple in structure and small in size.

It is a further object of the present invention to provide an improved fuel injecting apparatus which is low in cost.

To achieve the above mentioned objects, a fuel injecting apparatus in accordance with this invention comprises a housing which includes a fuel inlet and an air inlet, a bobbin around which a coil is wound and which is disposed in the housing, a first core member disposed at one side of the bobbin, a second core member disposed in the bobbin so as to be defined a clearance with the first core member, a nozzle disposed at one end of the housing and which includes an injecting opening at one end thereof, a mixture chamber disposed in the housing and always connected with the air inlet, a fuel chamber disposed in the housing and connected with the fuel inlet, a first movable member disposed in the bobbin and which includes a first projection portion which has a first gap with the second core member, a second movable member disposed in the bobbin and which includes a second projection portion which has a second gap with the first core member, the second movable member includes a first fuel passage and fuel measuring means therein, a third movable member slidably fit in the nozzle so as to be defined a third gap at one end thereof with the second movable member, the third movable member includes an outward opening valve to open and close the injecting opening at the other end thereof, the third movable member further includes a second fuel passage there in which connects the first fuel passage and the mixture chamber, valve means disposed between the first movable member and the second movable member, the valve means connects and disconnects the fuel chamber and the first fuel passage, a first spring member disposed between the first core member add the second movable member, the first spring member forces the second movable member so as to close the valve means, a second spring member disposed between the first core member and the first movable member, the second spring member forces the first movable member so as to open the valve means, the second spring member further includes spring force which is larger than that of the first spring member and a third spring member which forces the third movable member so as to close the injecting opening.

BRIEF DESCRIPTION OF THE DRAWINGS

The features and advantages of the fuel injecting apparatus according to the present invention will be more clearly appreciated from the following description in conjunction with the accompanying drawings wherein.

DETAILED DESCRIPTION OF PREFERRED EMBODIMENT OF THE INVENTION

Figure 1:
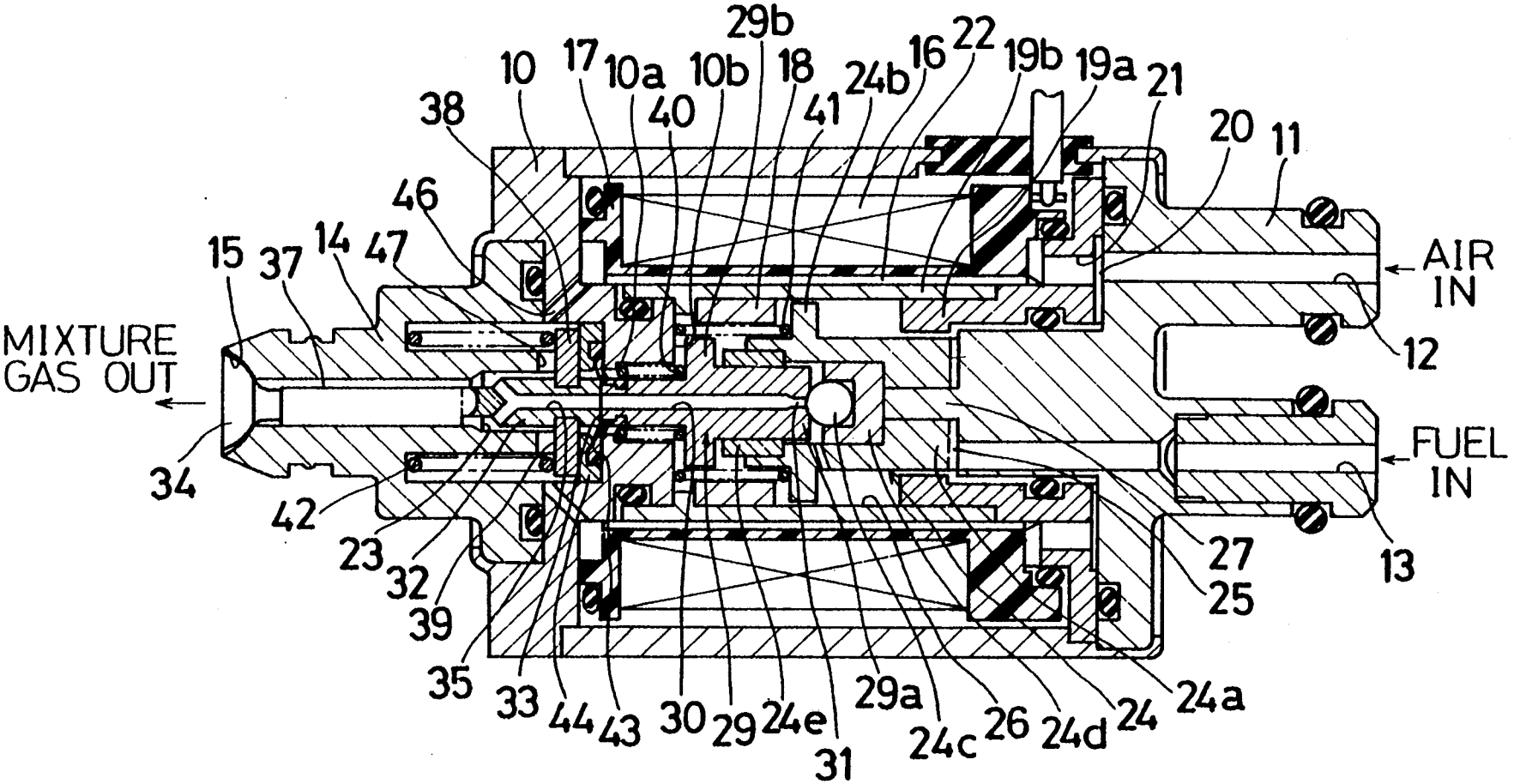
FIG. 1 is a sectional view of a fuel injecting apparatus of the present invention.

Referring to FIG. 1 a fuel injecting apparatus comprises a first core member 10 which also acts as a case and a housing 11 fixed on the right side of the first core member 10 shown in the FIG. 1 and which includes an air inlet 12 for introducing high pressure air and a fuel inlet 13 for introducing fuel. The first core member 10 includes a first stepped portion 10*a* and a second stepped portion 10*b* which is provided at radially outer location to the first stepped portion 10*a*. A nozzle 14 is fixed on the left side of the first core member 10 and includes an injecting opening 15 at a tip thereof.

A bobbin 17 is disposed in the housing 11. The bobbin 17 is formed of non-magnetic material and a coil 16 is wound around the bobbin 17. A second core member 18 which is formed of magnetic material is disposed in a center hole of the bobbin 17 so as to define a clearance with the first core member 10. A transmission member 19*a* which is formed of the magnetic material is disposed between the bobbin 17 and the housing 11. A non-transmission member 19*b* is fixed to the transmission member 19*a* so as to be located between the second core member 18 and the bobbin 17. The non-transmission member 19*b* is fit with the second core member 18. The non-transmission member 19*b* is formed of the non-magnetic material. The transmission member 19*a* includes a slot 20 always connected with the air inlet 12 and a first air passage 21. A second air passage 22 is disposed between the bobbin 17 and the non-transmission member 19*b*. The second air passage 22 is connected with the first air passage 21. The second air passage 22 is always connected with a mixture chamber 23 formed in the nozzle 14 through a third air passage 46 and a forth air passage 47. Since the mixture chamber 23 is always connected with the air inlet 12, the mixture chamber 23 is filled with the air under the high pressure.

A first movable member 24 formed of the magnetic material is disposed in the center hole of the bobbin 17 so as to be able to be slid in the right and left directions shown in the FIG. 1. The first movable member 24 includes a main member 24*a* formed of the magnetic material and which has a first projection portion 24*b* formed of the magnetic material, a ball 24*c* (as a valve member) formed of the non-magnetic material, an intermediate member 24*d* formed of the non-magnetic material and a contact member 24*e* formed of the non-magnetic material. The main member 24*a* is approximately formed in the C-shaped configuration and the main member 24*a*, is contacted with the housing 11 when the coil 16 is not flowing with electric current. The first projection portion 24*b* is opposite to the second core member 18 so as to be define a first gap with the second core member 18. The first projection portion 24*b* is attracted to the second core member 18 by the magnetic field generated between the first projection portion 24*b* and the second core member 18 when the coil 16 is flowing with the electric current.

The intermediate member 24*d* is inserted into the main member 24*a* and is also formed in the C-shaped configuration. The ball 24*c* is fit in the intermediate member 24*d* and the contact member 24*e* is fixed on a tip of the main member 24*a*.

The first movable member 24 includes a slot 25 at the right end thereof which is connected with the fuel inlet 13. A fuel chamber 26 is provided between the main member 24*a* and the non-transmission member 19*b* which is connected with the slot 25. A guide member 27 which is fix on the housing 11 is inserted into the main member 24*a*.

A second movable member 29 formed of the magnetic material is disposed in the second core member 18 so as to be able to be slid in the right and left directions shown in the FIG. 1. The second movable member 29 includes a valve seat 29*a* and a second projection portion 29*b*. The valve seat 29*a* is set to be contacted with and separated from the ball 24*c* of the first movable member 24 selectively. The second projection portion 29*b* is opposite to the second stepped portion 10*b* of the first core member 10 so as to define a second gap with the second stepped portion lob. The second projection portion 29*b* is attracted to the second stepped portion 10*b* by the magnetic field generated between the second projection portion 29*b* and the second stepped portion 10*b* when the coil 16 is flowing with the electric current. The second movable member 29 includes a first fuel passage 30 therein. The first fuel passage 30 is connected with the fuel chamber 26 when the ball 24*c* is separated from the valve seat 29*a*. An orifice 31 is formed in the first fuel passage 30. A predetermined quantity of the fuel is supplied into the mixture chamber 23 through the orifice 31 regardless of the degree of separator of the ball 24*c* from the valve seat 29*a*.

A first spring member 40 is disposed between the first stepped portion 10*a* of the first core member 10 and the second projection portion 29*b* of the second movable member 29. The first spring member 40 forces the second movable member 29 in the right direction shown in the FIG. 1 so as to contact the valve seat 29*a* with the ball 24*c*. A second spring member 41 is disposed between the second stepped portion 10*b* of the first core member 10 and the first projection portion 24*b* of the first movable member 24. The second spring member 41 forces the first movable member 24 in the right direction shown in the FIG. 1 so as to separate the ball 24*c* from the valve seat 29*a* with a spring force which is larger than that of the first spring member 40.

A third movable member 32 is disposed at the left side of the second movable member 29 shown in the FIG. 1 so as to define a third gap 33 with the second movable member 29. The third movable member 32 can be slid in the right and left directions shown in the FIG. 1. The third movable member 32 is extended in the horizontal direction in the nozzle 14 and the third movable member 32 includes an outward opening valve 34 at a tip thereof. The third movable member 32 includes a second fuel passage 35 which is always connected with the first fuel passage 30 and the mixture chamber 23. A third fuel passage 37 is set between the nozzle 14 and the third movable member 32 which is connected with the mixture, chamber 23. Therefore, the air under the high pressure is always supplied into the third fuel passage 37.

A circular retainer 38 is fixed to the third movable member 32. The third movable member 32 i s biassed in the right direction shown in the FIG. 1 by a third spring member 42 through the circular retainer 38 so as to close the injecting opening 15. A fourth gap 39 which is provided for corresponding to the stroke of the third movable member 32 is disposed between the left side of the fourth fuel passage 47 shown in the FIG. 1 and the circular retainer 38.

A stopper member 44 is snugly fit in the first core member 10. A diaphragm 43 is fixed to the stopper member 44 at one end thereof. Further the other end of the diaphragm 43 is supported on the second movable member 29 so as to partition the mixture chamber 23 from the fuel chamber 26.

Figure 2:
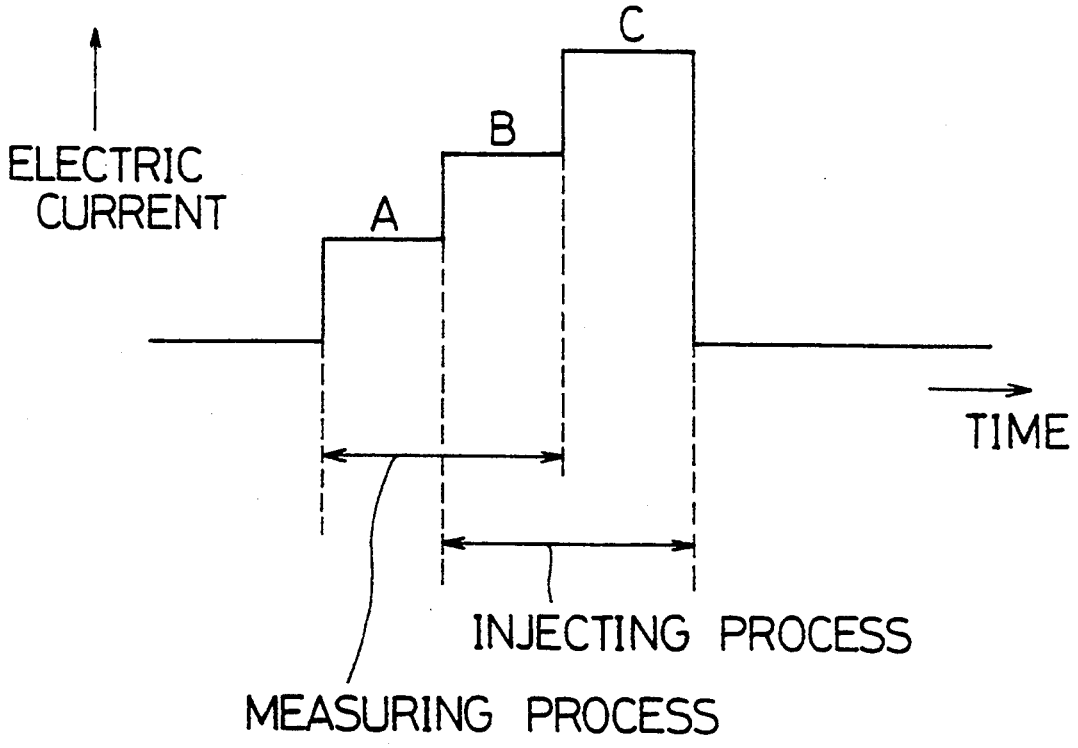
FIG. 2 is a diagram in explaining the operation of a fuel injecting apparatus of the present invention.

An operation of the fuel injecting apparatus mentioned above will be described hereinafter based on the FIGS. 1 and 2. In the FIG. 2, processes of the operation of the fuel injecting apparatus are indicated as A, B and C.

As mentioned above, the air under the high pressure is always supplied into the mixture chamber 23 and the fuel injecting passage 37. The fuel under the high pressure which is higher than that of the air always supplied into the fuel chamber 26.

[FIRST STAGE (shown as A in FIGS. 2 and 4)]

When a small amount of the electric current is flowing into the coil 16 by a fuel injecting control apparatus 50 which will be described later, an electromagnetic force which is larger than the spring force of the first spring member 40 is generated between the second stepped portion 10*b* of the first core member 10 and the second projection portion 29*b* of the second movable member 29 and the other electromagnetic force which is smaller than the spring force of the second spring member 41 is generated between the second core member 18 and the first projection portion 24*b* of the first movable member 24. Since the second movable member 29 is attracted to the second stepped portion 10*b* of the first core member 10, the second movable member 29 is slid in the left direction shown in the FIG. 1 against the spring force of the first spring member 40. Therefore the valve seat 29*a* of the second movable member 29 is separated from the ball 24*c* of the first movable member 24. Consequently, the fuel in the fuel chamber 26 is supplied into the mixture chamber 23 through the first fuel passage 30 and the second fuel passage 35. In the process the second movable member 29 is contacted with the third movable member 32 so as to fill up the third gap 33.

[SECOND STAGE (shown as B in FIGS. 2 and 4)]

At the second stage as the next process of the first silage, when a large amount of electric current is flowing into the coil 16, the electromagnetic force which is larger than the sum of the spring force of the first spring member 40 and the third spring member 42 is generated between the second stepped portion 10*b* of the first core member 10 and the second projection portion 29*b* of the second movable member 29 and the other electromagnetic force which is smaller than the spring force of the second spring member 41 is generated between the second core member 18 and the first projection portion 24*b* of the first movable member 24. Since the second movable member 29 which is in abutment with the third movable member 32 is attracted even stronger from the second stepped portion 10*b* of the first core member 10, the valve seat 29*a* of the second movable member 29 is further separated from the ball 24*c* of the first movable member 24. Furthermore, the third movable member 32 is slid in the left direction against the spring force of the third spring member 42 by the second movable member 29. Since the outward opening valve 34 is opened, the fuel in the mixture chamber 23 is injected out through the fuel injecting passage 37 with the high pressure air. On the other hand the fuel is supplied into the mixture chamber 23 through the fuel chamber 26, the first fuel passage 30 and the second fuel passage 35. At this time a predetermined quantity of the fuel is supplied into the mixture chamber 23 with the orifice 31. That is to say, during the second stage, measuring and injecting of the fuel are conducted at the same time. The third movable member 32 and the second movable member 29 are slid together in the left direction with a stroke which is the same as a size of the fourth gap 39. Consequently, the third movable member 32 is retained by the left wall of the fourth fuel passage 47.

[THIRD STAGE (shown as C in FIGS. 2 and 4)]

At the third stage as the next process of the second stage, when the largest amount of electric current is flowing into the coil 16, the electromagnetic force which is larger than the spring force of the second spring member 41 is generated between the second core member 18 and the first projection portion 24*b* of the first movable member 24. Since the first movable member 24 is attracted to the first core member 18, the first movable member 24 is slid in the left direction shown in the FIG. 1 against the spring force of the second spring member 41. Therefore the ball 24*c* is again contacted with valve seat 29*a* so as to disconnect the fuel chamber 26 with the mixture chamber 23. On the other hand, since the outward opening valve 34 is still opened, the fuel in the first fuel passage 30, the second fuel passage 35, the mixture chamber 23 and the fuel injecting passage 37 is injected out with the high pressure air.

As the above mentioned, in accordance with the invention because the fuel injecting apparatus comprises the second stage on which the measuring process and the injecting process are conducted simultaneously, both of the processes are secured to be sufficiently long. Therefore the sufficient fuel can be injected into the engine which rotates with the high speed. Furthermore, in accordance with the invention one cycle which includes the measuring process and the injecting process can be short.

Figure 3:
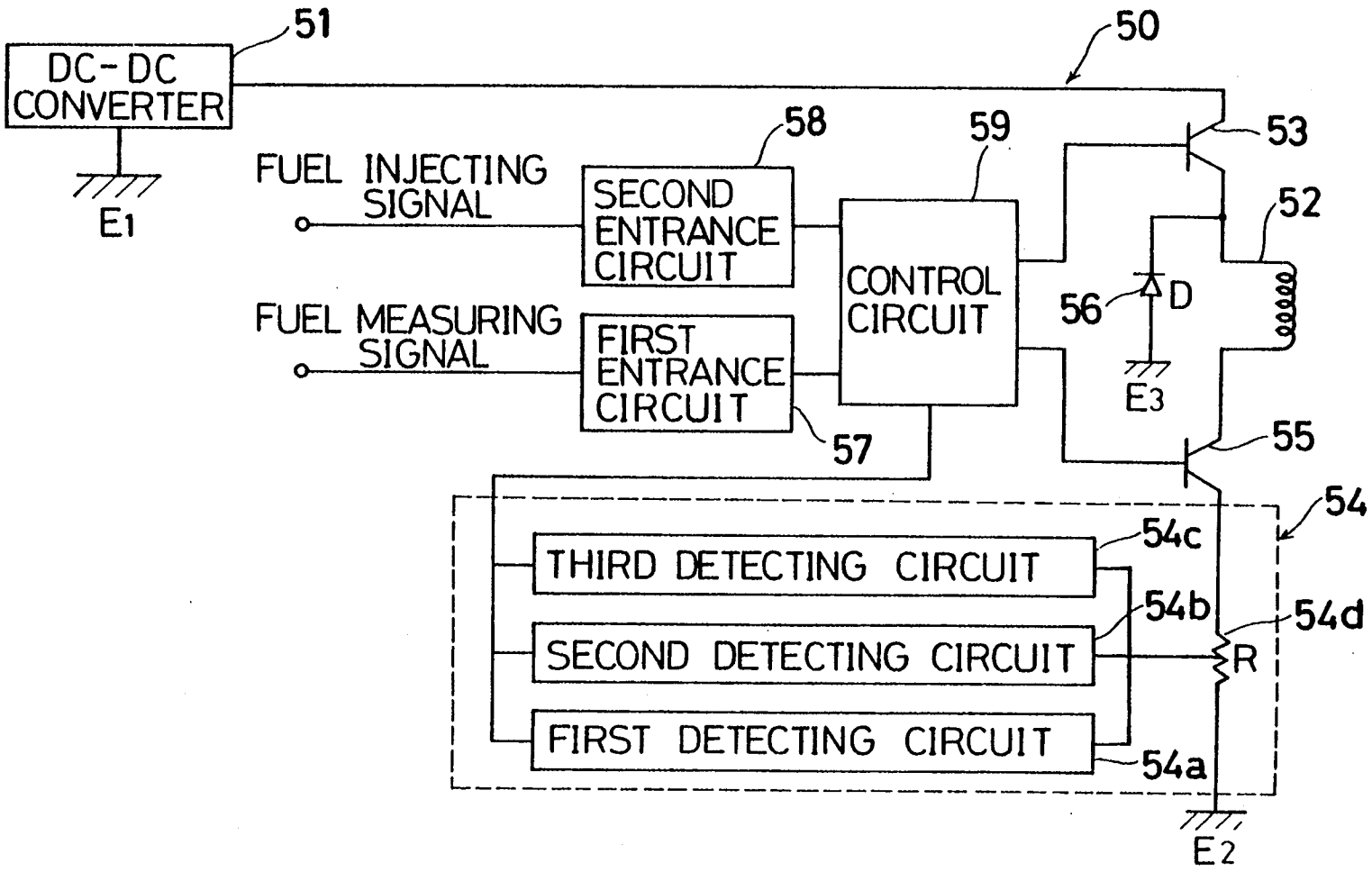
FIG. 3 is a block diagram of a fuel injecting control apparatus used for controlling a fuel injecting apparatus of the present invention.

The fuel injecting control apparatus 50 will be described with the FIGS. 3 and 4 hereinafter. The fuel injecting control apparatus 50 is used for controlling the quantity of the electric current which is flowing in a coil 52 (corresponding to the coil 16 shown in the FIG. 1). The reference numeral 51 indicates a DC-DC converter of which one end is connected with a ground E1 through a battery not shown in the FIGURES. The DC-DC converter 51 is provided for ascending the electric voltage derived from the battery to a predetermined value. The other end of the DC-DC converter 51 is connected with one end of the coil 52 through a first switch element 53. The other end of the coil 52 is connected with one end of an electric current detecting portion 54*d* of electric current detecting means 54 through a second switch element 55. Further the other end of the electric current detecting portion 54*d* is connected with a ground E2. The switch element 55 is set ON so as to connect the coil 52 and the electric current detecting portion 54*d*, when the electric current is flowing in the coil 52. The electric current detecting portion 54*d* is provided for detecting the quantity of the electric current which is flowing in the coil 52.

One end of a diode 56 is connected with a portion between the first switch element 53 and the coil 52. The other end of the diode 56 is connected with a ground E3. Further the diode 56 includes a predetermined internal resistance.

The electric current detecting portion 54*d* is connected with each of a first detecting circuit 54*a*, a second detecting circuit 54*b* and a third detecting circuit 54*c* so as to input an output signal which is sent from the electric current detecting portion 54*d* into each of them. The first detecting circuit 54a is provided for detecting whether the quantity of the electric current flowing in the coil 52 reaches to a first predetermined value shown as I1 in the FIG. 4 and whether the quantity of the electric current flowing in the coil 52 descends to a second predetermined value shown as I1′ in the FIG. 4 slightly smaller than the first predetermined value I1. The second detecting circuit 54*b* is provided for detecting whether the quantity of the electric current flowing in the coil 52 reaches to a third predetermined value shown as I2 in the FIG. 4 and whether the quantity of the electric current flowing in the coil 52 descends to a fourth predetermined value shown as I2′ in the FIG. 4 slightly smaller than the third predetermined value I2. Furthermore, the third detecting circuit 54*c* is provided for detecting whether the quantity of the electric current flowing in the coil 52 reaches to a fifth predetermined value shown as I3 in the FIG. 4 and whether the quantity of the electric current flowing in the coil 52 descends to a sixth predetermined value shown as I3′ in the FIG. 4 slightly smaller than the fifth predetermined value I3.

An output signal sent from each of the detecting circuits 54*a*, 54*b* and 54*c* i s input into a control circuit 59. Further, an output signal sent from each of a first entrance circuit 57 and a second entrance circuit 58 is also input into the control circuit 59. The first entrance circuit 57 and the second entrance circuit 58 receive each of a fuel measuring signal and a fuel injecting signal respectively. The control circuit 59 switches the switch elements 53 and 55 to ON or OFF according to the output signals, sent from the entrance circuits 57 and 58 and the detecting circuits 54*a*, 54*b* and 54*c* . Especially, when the quantity of the electric current flowing into the coil 52 reaches to the predetermined values I1, I2 and I3, the control circuit 59 switches the first switch element 53 into OFF. Further, when the quantity of the electric current flowing into the coil 52 descends to the predetermined values I1′, I2′ and I3′, the control circuit 59 switches the first switch element 53 into ON.

An operation of the fuel injecting control apparatus 50 will be described with the FIGS. 3 and 4 hereinafter. In the FIG. 4 the diagram which shows the relation between the quantity of the electric current I flowing in the coil 52 and the time T is disclosed.

[FIRST STAGE (shown as A in FIGS. 2 and 4)]

When the first entrance circuit 57 receives the fuel measuring signal and sends an output signal to the control circuit 59, the control circuit 59 switches the switch elements 53 and 55 into ON. Therefore, the electric current instantly flows from the battery (not shown in the FIGURES) to the ground E2 through the DC-DC converter 51, the first switch element 53, the coil 52, the second switch element 55 and the electric current detecting portion 54*d* (shown as T1 in the FIG. 4). The electric current detecting portion 54*d* always detects the quantity of the electric current flowing into the portion 54*d*. The portion 54*d* sends the output signal which indicates the quantity of the electric current to the first detecting circuit 54*a*.

Figure 4:
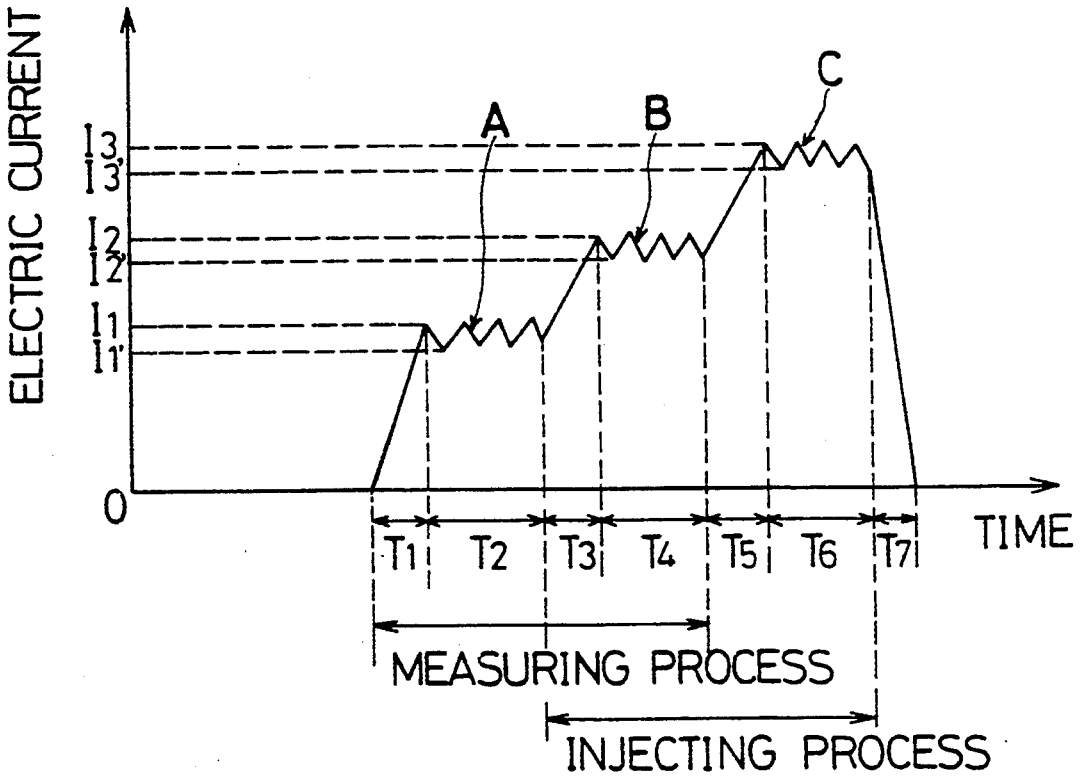
FIG. 4 is a detailed diagram in explaining the operation of a fuel injecting apparatus of the present invention.
Figure 5:
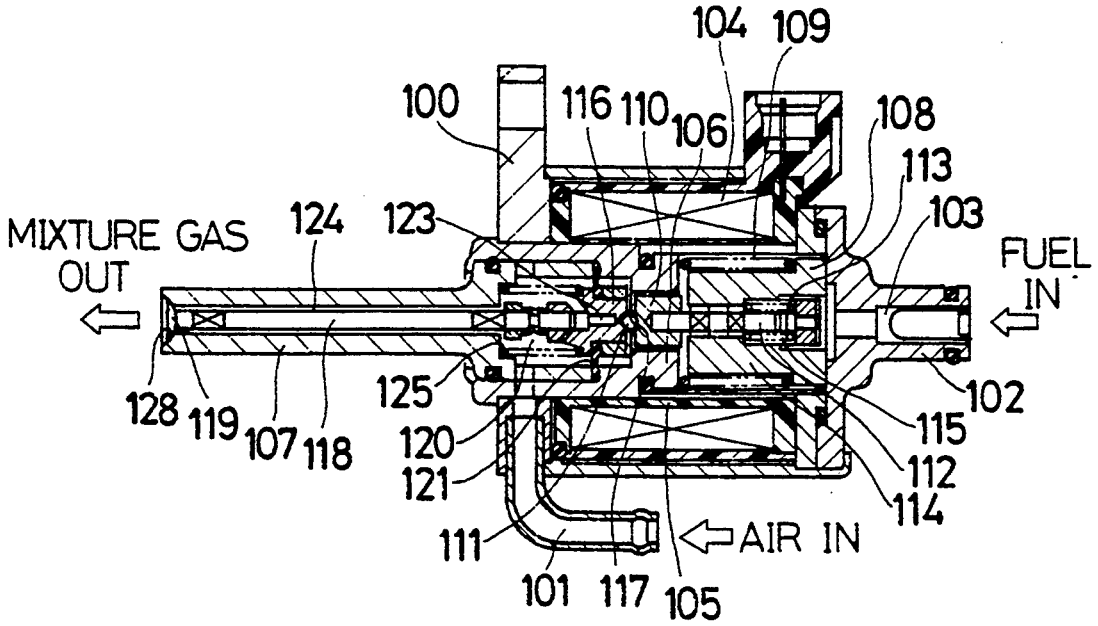
Fig. 5 PRIOR ART
FIG. 5 is a sectional view of a conventional fuel injecting apparatus.
Figure 6:
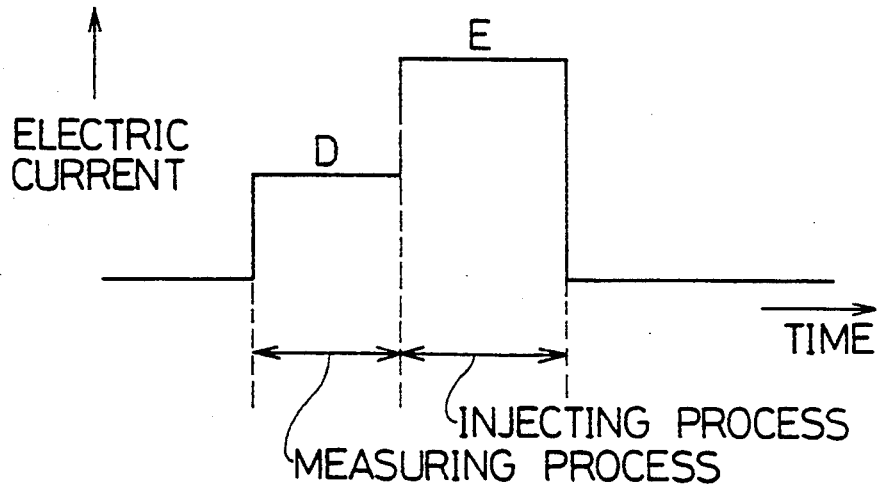
Fig. 6 PRIOR ART
FIG. 6 is a diagram in explaining the operation of a conventional fuel injecting apparatus.

When the quantity of the electric current flowing into the coil 52 reaches the first predetermined value I1 shown in the FIG. 4, the first detecting circuit 54*a* sends an output signal to the control circuit 59. Receiving the signal, the control circuit 59 switches the first switch element 53 into OFF. Therefore, the DC-DC converter 51 is disconnected with the coil 52. Consequently, because a counter electromotive force is generated in the coil 52, the electric current flowing from the coil 52. Therefore the electric current cycles around the circuit which is formed of the coil 52, the second switch element 55, the electric current detecting portion 54*d*, the grounds E2, E3 and the diode 56. The quantity of the electric current flowing into the coil 52 is gradually descended by the internal resistance of the diode 56.

When the quantity of the electric current flowing into the coil 52 is descended to the second predetermined value I1' shown in the FIG. 4, the first detecting circuit 54*a* sends an output signal to the control circuit 59. Receiving the signal, the control circuit 59 switches the first switch element 53 into ON. Therefore, the DC-DC converter 51 is connected with the coil 52. Consequently, the electric current, which flows from the battery (not shown in the FIGURES) to the ground E2 through the DC-DC converter, the first switch element 53, the coil 52, the second switch element 55 and the electric current detecting portion 54*d*, is gradually increased to the first predetermined value I1. Because the operation mentioned above is repeated during a time T2 shown in the FIG. 4 and which is indicated by the output signal from the first entrance circuit 57, the electric current shown as I1, I1' in the FIG. 4 is flowing into the coil 52.

[SECOND STAGE (shown as B in FIGS. 2 and 4)]

When both the first entrance circuit 57 and the second entrance circuit 58 receive each of the fuel measuring signal and the fuel injecting signal respectively, each of the first entrance circuit 57 and the second entrance circuit 58 sends an output signal to the control circuit 59. Receiving the output signals from the entrance circuit 57, 58, the control circuit 59 flows the electric current, which is larger than that on the first stage, into the coil 52 (shown as T3 in the FIG. 4). The electric current detecting portion 54*d* always detects the quantity of the electric current flowing into the portion 54*d*. The portion 54*d* sends the output signal which indicates the quantity of the electric current to the second detecting circuit 54*b*.

When the quantity of the electric current flowing into the coil 52 reaches the third predetermined value I2 shown in the FIG. 4, the second detecting circuit 54*b* sends an output signal to the control circuit 59. Receiving the signal, the control circuit 59 switches the first switch element 53 into OFF. Therefore, the DC-DC converter 51 is disconnected with the coil 52. Consequently, because a counter electromotive force is generated in the coil 52, the electric current flows from the coil 52. Therefore the electric current cycles around the circuit formed of the coil 52, the second switch element 55, the electric current detecting portion 54*d*, the grounds E2, E3 and the diode 56. The quantity of the electric current flowing into the coil 52 is gradually descended by the internal resistance of the diode 56.

When the quantity of the electric current flowing into the coil 52 is descended to the fourth predetermined value I2' shown in the FIG. 4, the second detecting circuit 54*b* sends an output signal to the control circuit 59. Receiving the signal, the control circuit 59 switches the first switch element 53 into ON. Therefore, the DC-DC converter 51 is connected with the coil 52. Consequently, the electric current, which is flowing from the battery (not shown in the FIGURES) to the ground E2 through the DC-DC converter, the first switch element 53, the coil 52, the second switch element 55 and the electric current detecting portion 54*d*, is gradually increased to the third predetermined value I2. Because the operation mentioned above is repeated during a time T4 shown in the FIG. 4 and which is indicated by the output signal from the entrance circuits 57, 58, the electric current shown as I2, I2' in the FIG. 4 is flowing into the coil 52.

[THIRD STAGE (shown as C in FIGS. 2 and 4)]

When the second entrance circuit 58 receives the fuel injecting signal and the first entrance circuit 57 does not receive the fuel measuring signal, the second entrance circuit 58 sends the output signal to the control circuit 59. Receiving the output signal from the second entrance circuit 58, the control circuit 59 flows the electric current which is larger than that on the second stage, into the coil 52 (shown as T5 in the FIG. 4). The electric current detecting portion 54*d* always detects the quantity of the electric current flowing into the portion 54*d*. The portion 54*d* sends the output signal which indicates the quantity of the electric current to the third detecting circuit 54*c*.

When the quantity of the electric current flowing into the coil 52 reaches to the fifth predetermined value I3 shown in the FIG. 4, the third detecting circuit 54*c* sends an output signal to the control circuit 59. Receiving the signal, the control circuit 59 switches the first switch element 53 into OFF. Therefore, the DC-DC converter 51 is disconnected with the coil 52. Consequently, because a counter electromotive force is generated in the coil 52, the electric current flows from the coil 52. Therefore the electric current cycles around the circuit formed of the coil 52, the second switch element 55, the electric current detecting portion 54*d*, the grounds E2, E3 and the diode 56. The quantity of the electric current flowing into the coil 52 is gradually descended by the internal resistance of the diode 56.

When the quantity of the electric current flowing into the coil 52 is descended to the sixth predetermined value I3' shown in the FIG. 4, the third detecting circuit 54*c* sends an output signal to the control circuit 59. Receiving the signal, the control circuit 59 switches the first switch element 53 into ON. Therefore, the DC-DC converter 51 is connected with the coil 52. Consequently, the electric current, which is flowing from the battery (not shown in the FIGURES) to the ground E2 through the DC-DC converter, the first switch element 53, the coil 52, the second switch element 55 and the electric current detecting portion 54*d*, is gradually increased to the fifth predetermined value I3. Because the operation mentioned above is repeated during a time T6 shown in the FIG. 4 and which is indicated by the output signal from the second entrance circuit 58, the electric current shown as I3, I3′ in the FIG. 4 flows into the coil 52.

When the injecting process has come to an end, the control circuit 59 switches the switch elements 53 and 55 into OFF. Therefore, the electric current which flows into the coil 52 is rapidly decreased to zero (shown as T7 in the FIG. 4).

As mentioned above, in accordance with the invention the electric current can be descended to the predetermined value by the internal resistance of the diode 56 disposed in the portion between the coil 52 and the first switch element 53. Therefore, the interval between the switching operations of the first switch element 53 can be lengthened and the number of switching operations of the first switch element 53 also can be decreased. Furthermore, the second switch element 55 is not switched, when the electric current continues to flow into the coil 52. Consequently, the switch elements 53, 55 are prevented from heating and the switch elements 53, 55.

While the invention has been particularly shown and described with reference to preferred embodiment thereof, it will be understood by those skilled in the art that the foregoing and other changes in form and details can be made therein without departing from the spirit and scope of the invention.

What is claimed is:

1. A fuel injecting apparatus comprising:

measurement means for measuring a quantity of fuel;

injection means for injecting the quantity of fuel measured by the measurement means;

controlling means generating first, second and third control signals for controlling the measuring and injection of fuel;

means for establishing a first operational stage based on said first signal during which said measurement means is operated;

means for establishing a second operational stage based on said second signal during which said measurement means and said injection means are operated; and means for establishing a third operational stage based on said third signal during which said injection means is operated.

2. A fuel injecting apparatus as recited in claim 1, including a housing in which is disposed a bobbin, and a coil wound around the bobbin, said controlling means generating the first, second and third control signals to control the quantity of electric current flowing in the coil.

3. A fuel injecting apparatus as recited in claim 1, including a first core member, a housing disposed at one end of the first core member, a nozzle connected to one end of the first core member, a bobbin positioned within the housing and a coil wound around the bobbin, a mixture chamber formed in the nozzle to mix fuel and air, a first movable member of magnetic material positioned within a hole in the bobbin; a second core member disposed in the hole in the bobbin, a second movable member of magnetic material positioned within the second core member, said second movable member including a valve seat which is engageable with and disengageable from a ball, said second movable member being moved to disengage the valve seat from the ball in the first operational stage to permit fuel to flow into the mixture chamber.

4. A fuel injecting apparatus as recited in claim 3, including a third movable member disposed adjacent one end of the second movable member, said third movable member extending into the nozzle and including an opening valve which closes and opens the nozzle, said third movable member being moved by the second movable member during the second operational stage to move the opening valve and open the nozzle so that the fuel and air in the mixture chamber is injected out through the nozzle.

5. A fuel injecting apparatus as recited in claim 4, including a spring disposed between the first core member and the first movable member to provide a biasing force which normally urges, the first movable member away from the first core member, said first movable member being moved toward the first core member against the biasing force of the spring during the third operational stage to urge the ball against the valve seat and prevent the flow of fuel to the mixture chamber.

6. A fuel injecting apparatus comprising:

a housing which includes a fuel inlet and an air inlet;

a bobbin around which a coil is wound and which is disposed in the housing;

a first core member disposed at one side of the bobbin;

a second core member disposed in the bobbin so as to define a clearance with the first core member;

a nozzle disposed at one end of the housing and which includes an injecting opening at one end thereof;

a mixture chamber disposed in the housing and always connected with the air inlet;

a fuel chamber disposed in the housing and connected with the fuel inlet;

a first movable member disposed in the bobbin and which includes a first projection portion which has a first gap with the second core member;

a second movable member disposed in the bobbin and which includes a second projection portion which has a second gap with the first core member, the second movable member includes a first fuel passage and fuel measuring means therein;

a third movable member slidably fit in the nozzle so as to be defined a third gap at one end thereof with the second movable member, the third movable member includes an outward opening valve to open and close the injecting opening at the other end thereof, the third movable member further includes a second fuel passage therein which connects the first fuel passage and the mixture chamber;

valve means disposed between the first movable member and the second movable member, the valve means connects and disconnects the fuel chamber and the first fuel passage;

a first spring member disposed between the first core member and the second movable member, the first spring member forces the second movable member so as to close the valve means;

a second spring member disposed between the first core member and the first movable member, the second spring member forces the first movable member so as to open the valve means, the second spring member includes spring force which is larger than that of the first spring member; and a third spring member which forces the third movable member so as to close the injecting opening.

7. A fuel injecting apparatus as recited in claim 6, wherein the fuel measuring means is in the form of an orifice.

8. A fuel injecting apparatus as recited in claim 6, wherein the valve means include a ball fixed on the first movable member and a valve seat disposed on the second movable member.

9. A fuel injecting apparatus comprising:

a coil for generating electromagnetic power;

a first movable member which is moved by electromagnetic power generated by said coil;

a second movable member which is moved by electromagnetic power generated by said coil;

a third movable member which is moved as a result of electromagnetic power generated by said coil;

first means for establishing a first operational stage during which a quantity of fuel is measured;

second means for establishing a second operational stage after the first operational stage during which high pressure air and at least the quantity of fuel measured in the first operational stage are injected and during which a quantity of fuel is measured;

third means for establishing a third operational stage after the second operational stage during which high pressure air and at least the quantity of fuel measured in the second operational stage are injected;

a measuring valve positioned between the first and second movable members for being opened and closed, the measuring valve being opened in the first and second operational stages and being closed in the third operational stage; and said second movable member being moved by a first electromagnetic power generated by the coil in the first operational stage and being moved by a second electromagnetic power generated by the coil in the second operational stage, said third movable member being moved by the second electromagnetic power generated by the coil in the second operational stage and a third electromagnetic power generated by the coil in the third operational stage, and said first movable member being moved by the third electromagnetic power generated by the coil in the third operational stage.

10. A fuel injecting apparatus as recited in claim 9, wherein said first means comprises the second movable member, the second means comprises the second and third movable members, and said third means comprises the first and third movable members.

11. A fuel injecting apparatus as recited in claim 9, including a mixture chamber in which air and fuel are mixed, said measuring valve including a valve seat formed on said second movable member and a ball positioned between said valve seat and said first movable member, said first movable member being moved during the third operational stage to engage the ball with the valve seat and prevent the flow of fuel to the mixture chamber.

12. A fuel injecting apparatus as recited in claim 9, including a housing positioned on one side of a first core member, the coil being wound around a bobbin positioned in the housing, and a nozzle fixed on one side of the first core member, said third movable member extending through the nozzle and including an opening valve which opens and closes the nozzle, said opening valve opening the nozzle to permit injection of high pressure air and fuel in the second and third operational stages and closing the nozzle to prevent injection of fuel and high pressure air in the first operational stage.

13. A fuel injecting apparatus as recited in claim 9, including a first spring operatively associated with the second movable member for urging the second movable member in a direction which closes the measuring valve.

14. A fuel injecting apparatus as recited in claim 13, including a housing positioned on one side of a core member, said coil being wound around a bobbin positioned in the housing, and a second spring disposed between the first movable member and the first core member for urging the first movable member away from the first core member.

15. A fuel injecting apparatus as recited in claim 14, including a nozzle fixed on one side of the core member, said third movable member extending through the nozzle and including an opening valve which opens and closes the nozzle, and a third spring operatively associated with the third movable member for normally urging the third movable member in a direction in which the nozzle is closed by the opening valve.

* * * * *